United States Patent [19]

Daniels

[11] 4,416,404

[45] Nov. 22, 1983

[54] BELT TYPE GARMENT FOR CARRYING TENNIS BALLS AND THE LIKE

[76] Inventor: Fitz A. S. C. Daniels, 6060 Duke St., Alexandria, Va. 22304

[21] Appl. No.: 461,227

[22] Filed: Jan. 26, 1983

[51] Int. Cl.[3] ..... B65D 85/00

[52] U.S. Cl. ..... 224/224; 224/919; 206/315.9

[58] Field of Search ..... 224/224, 223, 242, 251, 224/919; 206/315 B; 2/247, 250, 312, 318, 320

[56] References Cited

U.S. PATENT DOCUMENTS

| | | | |
|---|---|---|---|
| 1,911,256 | 5/1933 | Andrew | 224/919 X |
| 2,558,382 | 6/1951 | Previdi | 224/223 |
| 3,047,140 | 7/1962 | Robins | 206/315 B |
| 3,320,620 | 5/1967 | Weidler et al. | 2/250 |
| 3,968,522 | 7/1976 | Riess | 224/919 X |
| 4,042,156 | 8/1977 | Knight | 224/919 X |
| 4,085,872 | 4/1978 | Foo | 206/315 B X |

*Primary Examiner*—Steven M. Pollard

[57] ABSTRACT

A belt type garment for carrying tennis balls and the like comprises a belt portion having on one extremity devices thereon for removably fastening the belt portion around the waist of the wearer. A tubular section for carrying at least one of the balls has its longitudinal seam secured to the rear surface of the belt such that the belt passes through the tubular section longitudinally at the inner circumference. At opposite exremities of the tubular section, symmetrical orifices with throats constricted transversely to the tubular axis by elongate elastic strips which are secured to the inner circumference at each throat station in the stretched condition such that when the elastic is relaxed, a plurality of successive gathers extends circumferentially at each throat forming between them the storage compartment and adjacently an infundibuliform orifice with a forward facing semi-elliptical perimeter. The elastically constricted throats allow for ease of insertion and removal of the balls while at the same time providing a secure compartment for retaining the balls during play.

8 Claims, 6 Drawing Figures

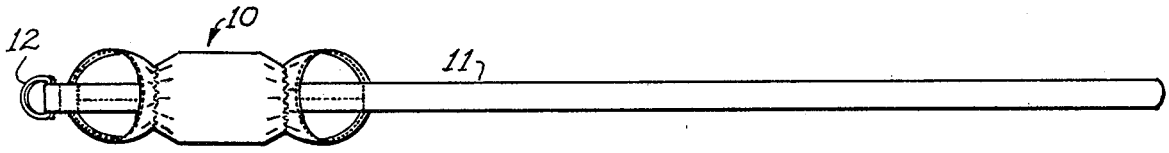
Fig 1
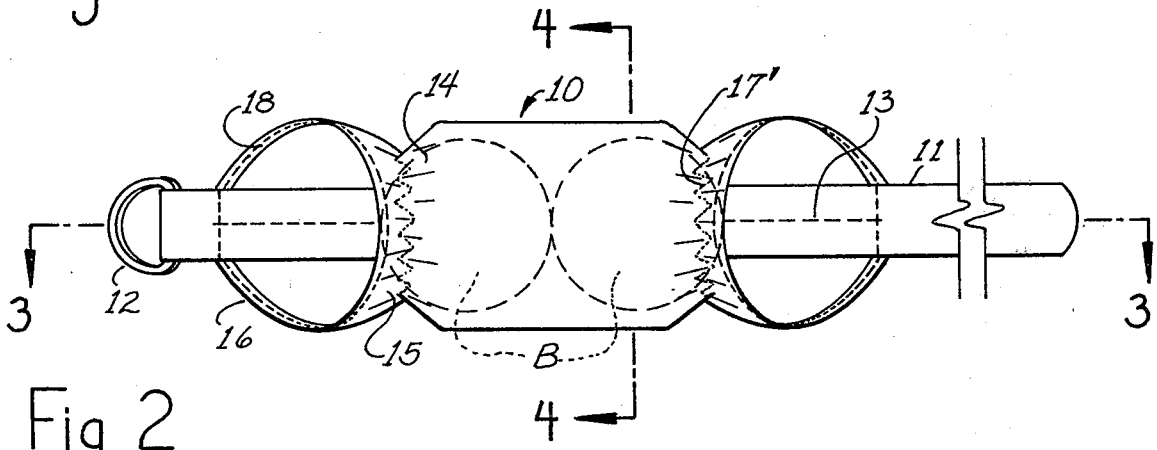
Fig 2
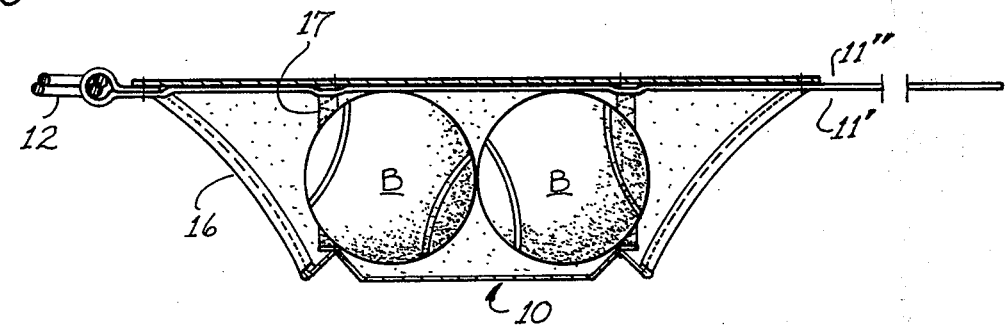
Fig 3
Fig 4
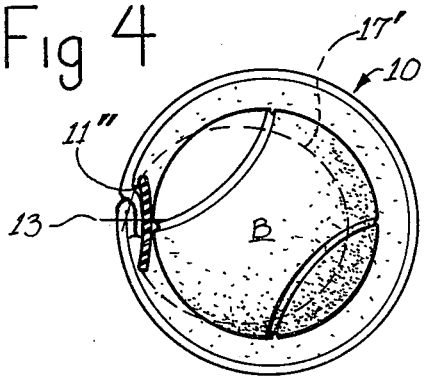
Fig 5
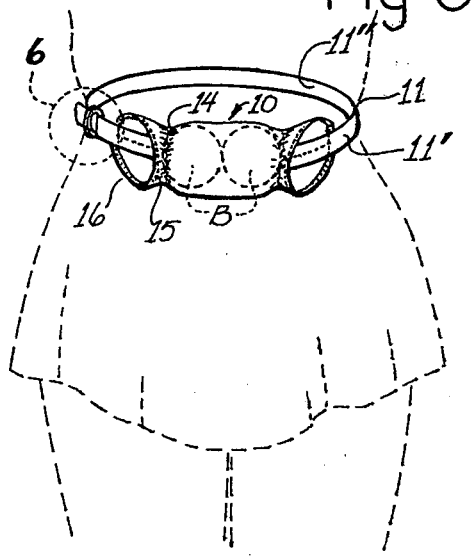
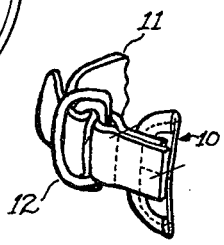
Fig 6

BELT TYPE GARMENT FOR CARRYING TENNIS BALLS AND THE LIKE

BACKGROUND OF THE INVENTION

This invention relates to a belt type garment for carrying tennis balls and the like.

In the playing of tennis it is well known and is desirable for each player to have a least two balls available when serving. Since the player has two serves, it is desirable not to interrupt or delay play of the game waiting for ball retrieval and accordingly most players either hold a spare ball (or balls), in the pockets of tennis shorts, dresses, or skirts. Unfortunately, the pockets in these garments are not usually designed for the storage of tennis balls and when so used can be a source of irritation to the player often spoiling his or her concentration and sometimes damaging their clothing as well due to stress on sewn seams. The prior art shows devices of the belt type or clip on type that have been proposed and utilized in the past but none appear to have been commercially successful. Some devices were cumbersome to don, others were irritating to wear, some, it appeared could even be injurious to the wearer in an accidental fall or errant stroke. Still other devices while suitable for the task were sized to carry more balls than the player actually uses in the game of tennis thus making it ungainly for use by female or children players while in the converse, other devices were singular in capacity and required one device for each ball stowed. Finally, no device so far proposed it appears has been through its novelty able to induce its use on a wide scale.

The following listed patents are considered to be the most relevant with regard to the prior art on the subject:

| PAT. NO. | Inventor | Issue Date |
|---|---|---|
| U.S. 1,648,565 | Primley | November 8, 1927 |
| British 326,425 | Wachow et al | March 13, 1930 |
| U.S. 2,074,180 | Hatley | March 16, 1937 |
| U.S. 2,508,190 | Previdi | May 16, 1950 |
| U.S. 2,708,061 | Kotchka | May 10, 1955 |
| French 1,294,937 | Bessieres | April 24, 1962 |
| U.S. 3,601,815 | Strehlan | August 31, 1971 |
| U.S. 3,768,709 | Kinard | October 30, 1973 |
| U.S. 3,865,290 | Sperling | February 11, 1975 |
| U.S. 4,042,156 | Knight | August 16, 1977 |
| U.S. 4,079,871 | Sica | March 21, 1978 |

BRIEF SUMMARY OF THE INVENTION

It is the object of this invention to provide a device for carrying tennis balls and the like in a simple device which is small in size, complimentary to wear, of easy use, safe, and convenient for use by all ages and sexes.

Therefore, in practice of this invention and in accordance with the presently preferred embodiment there is provided a belt type garment for carrying tennis balls and the like, of simple construction and ease of use having a belt portion with on one extremity devices thereon for removably fastening the belt portion around the waist of the wearer. Means secure a tubular section for carrying a pair of tennis balls to the rear surface of the belt along its longitudinal seam at the inner circumference of the tubular section. At opposite extremities of the tubular section, in symmetry, orifices with throats constricted transversely to the tubular axis by elastic strips which means secure approximately two ball diameters apart in the stretched condition thereof circumferentially on the inner surface of the tubular section at the throats at each extremity defining, when the elastic strip is relaxed a plurality of gathers thus forming between said throats the storage compartment. Concurrent with the formation of the storage compartment by a plurality of gathers, a similar plurality of gathers also obtains on the adjacent extremities of the tubular section where are formed infundibuliform orifices with forward facing semi-elliptical perimeters for guiding the balls on insertion into the storage compartment. Ideally, the elastic shall be sized so as when relaxed it shall constrict the throats sufficiently to retain the balls; but when a ball is required, sufficient dilation can be caused with one hand easily to effect ball removal.

BRIEF DESCRIPTION OF THE DRAWINGS

When taken in conjunction with the accompanying drawings, other objects and advantages, as well as those aforementioned will appear in said drawings wherein:

FIG. 1 is a front elevational view of the belt type garment of this invention;

FIG. 2 is an enlarged front elevational view of the belt type garment of this invention with tennis balls, illustrated in dotted lines, disposed in the tubular storage compartment thereof;

FIG. 3 is a planar sectional view taken along line 3—3 of FIG. 2 illustrating the tennis balls disposed in the tubular storage compartment;

FIG. 4 is an enlarged sectional elevation along line 4—4 of FIG. 2 illustrating the spacial relationship of the tennis ball to the tubular storage compartment;

FIG. 5 is a view of the belt type garment of this invention in position on the wearer, illustrated in dotted lines, with tennis balls disposed in the tubular storage compartment thereof;

FIG. 6 is an enlarged perspective view of the area within the circle 6 of FIG. 5.

DESCRIPTION OF THE PREFERRED EMBODIMENT

Referring now to the drawings and more particulary to FIGS. 1 and 2 a belt type garment generally indicated in FIG. 1, is illustrated therein for use by a tennis player for carrying a pair of tennis balls. Though the preferred embodiment depicts a belt type garment of the invention dimensioned for a pair of tennis balls it can be seen that the device can be dimensioned to carry a plurality of balls of any size such as those used in the sports of golf, racquetball, handball, and the like.

The belt type garment preferably comprises an elongate longitudinal belt portion 11 having front and rear portions 11' and 11" respectively. The belt portion 11 further includes at one extremity means 12, thereon for removably fastening the belt portion around the waist of the wearer as shown in FIG. 5 with the rear surface 11" facing the wearer and the front surface 11' facing away from the wearer.

This means of fastening preferably comprises a pair of rings 12 which are illustrated enlarged in FIG. 6 which means secure in an enclosed loop at one extremity of the belt portion 11 for adjustably and removably fastening said belt portion 11 around the waist of the wearer. Each said ring is typically formed in the shape of the letter "D" and commonly called D-ring, of metal wire of suitable cross-sectional dimension and sufficient strength to resist deformation when the extremity of the belt portion 11 opposite to that extremity of said portion onto which said rings 12 are secured by means is threaded into said rings in a manner such that the said extremity is passed through the bights of both rings 12 encompassing the outer-most and inner-most ring with the belt portion 11 forming in section the figure of the letter "S", and drawn-up snugly around the waist of the wearer. Means for securing said rings 12 into an enclosed loop at one extremity of the belt portion 11 comprises stitching.

Although the preferred embodiment depicts and describes the means of removably fastening the belt portion 11 around the waist of the wearer in the form of metal D-rings 12; rings the same shape or alternately in the shape of the letter "O" and formed from a plastic of sufficient strength to resist deformation could be substituted for metal D-rings.

The belt portion 11 is preferably constructed of a textile fabric webbing to provide a flexible, washable belt portion similar to that commonly used for passenger restraint belts in the transportation industry.

The belt type garment of this invention further includes a tubular section 10 for carrying at least one of the tennis balls B and preferably two.

The tubular section 10 is preferably constructed of a textile fabric equal or similar to a cotton duck to provide a flexible, washable tubular section for the carrying of tennis balls and the like.

In FIG. 4 the longitudinal seam 13 of the tubular section 10 is fastened to the rear surface 11'' of the belt portion 11 with means which are preferably stitching in such a manner that the belt portion 11 passes through the tubular section 10 longitudinally at the inner circumference of said tubular section 10.

Since the tubular section 10 is symmetrical as regards one extremity to the other, the description and reference numerals for one extremity as recited below are equally applicable to the other.

In FIGS. 2 and 3 at opposite extremities of the tubular section 10, symmetrical orifices 16, with throats 17', are formed by elongate elastic strips 17, of less longitudinal length than that at their secured locations on the unassembled tubular section 10 which means secure to the inner circumference of said tubular section 10, in the stretched condition such that when the elastic 17 is relaxed, a plurality of successive gathers 14 and 15 extends circumferentially at throat 17' forming between them the storage compartment in which the balls B are illustrated. Means for securing the elastic strips 17 are preferably stitching; and more particularly so, a walking zig-zag stitch as illustrated in FIG. 2 at 17'. The flat pattern of the unassembled tubular section 10 is so cut that when assembled, the elongate elastic strips 17, secured by means which are in particular a walking zigzag stitch at 17' and when subsequently relaxed, cause to be formed near the extremities of the tubular section 10, an infundibuliform orifice 16, with a forward facing semi-elliptical perimeter 18. The rim of said perimeter being folded over 180 degrees onto itself 18 and with means, preferably stitching secured throughout the semi-elliptical perimeter 18.

FIG. 4 illustrates in dotted lines the outline of the throat opening 17' caused by the relaxation of the elongate elastic strips 17. Additionally, FIG. 4 illustrates the spacial and dimensional relationship of the tennis ball B in regard to the tubular storage compartment 10; noting in particular that the storage compartment 10, thereof illustrated is substantially larger in diameter than the tennis ball B allowing the wearer to insert his or her fingers into the tubular storage compartment 10 through the throat 17' and with slight radial pressure, dilate said throat 17' to a dimension equal to that of the tubular storage compartment 10, which at concurrent instant allows the wearer to partially encircle the tennis ball B with the thumb and fingers of one hand and easily extract the ball B from the tubular compartment 10. Conversely, insertion of the ball B into the storage compartment is accomplished in a similar manner except that the fingers of one hand radially dilate the throat 17' and the thumb of the same hand pushes the ball B through the throat 17' which continues to enlarge as a great circle of the tennis ball B passes through said throat.

The arrangement of the tubular storage compartment 10 with its infundibuliform orifices 16, and elastically constricted throats 17' provide a belt type garment for carrying tennis balls B and the like which eliminates problems of the prior art of this type and provides specific improvements and novel features in the construction thereof which have heretofore not been apparent, known or suggested.

The preceding drawings and specifications have set forth a preferred embodiment of this invention, and although specific terms are utilized in the description thereof, they shall be deemed generic for said descriptive sense only and not for the purposes of limitation.

What is claimed is:

1. A belt type garment for carrying tennis balls and the like comprising;

an elongate, longitudinally extending belt portion having front and rear surfaces and on one extremity thereof means thereon for removably fastening said belt portion around the waist of the wearer with said rear surface facing the wearer and said front surface facing away from the wearer; and a tubular section for carrying at least one of the balls having its longitudinal joinder secured by means to the rear surface of the belt portion such that the belt portion passes through the tubular section longitudinally at the inner circumference having an opposite extremities of the tubular section, symmetrical orifices having throats constricted transversely to the tubular axis by elongate elastic strips of less longitudinal length than the circumference of said tubular section which are by means secured to the inner circumference at each throat in the stretched condition such that when the elastic is relaxed, a plurality of successive gathers extends circumferentially at each throat forming between them a storage compartment and adjacently on each extremity of said tubular section infundibuliform orifices, with forward facing semi-elliptical perimeters;

whereby said elastically constricted throats allow for ease of insertion and removal of the ball while at the same time providing a secure compartment for containing the ball.

2. A belt type garment, as set forth in claim 1, in which said belt portion and said tubular section comprise textile fabric for providing a washable garment.

3. A belt type garment as set forth in claim 1, in which said means for fastening said belt portion adjustably around the waist of the wearer comprises a set of rings secured by means to one extremity of said belt portion and of sufficient strength to resist deformation when the opposite extremity of said belt portion is threaded into said rings in a manner that said extremity is passed through the bights of both rings encompassing the outer-most and inner-most ring with the belt portion forming in section the figure of the letter 'S' and drawn up snugly around the waist of the wearer.

4. A belt type garment as set forth in claim 1, in which the means of securing the means of fastening said belt portion around the waist of the wearer comprises stitching.

5. A belt type garment as set forth in claim 1, in which the means of securing the joinder of the tubular section to the rear surface of said belt portion coprises stitching.

6. A belt type garment as set forth in claim 1, in which the means of forming a storage compartment in the tubular section thereof comprises a set of elongate elastic strips of less longitudinal length than the circumference of said tubular section and which means secure transversely, circumferentially and spaced at least one ball's diameter apart in the tubular section thereof.

7. A belt type garment as set forth in claim 1, in which the means of securing said elongate elastic strips to the tubular section thereof comprises walking zig-zag stitching.

8. A belt type garment as set forth in claim 1, dimensioned to carry a plurality of tennis balls.

* * * * *